US010131031B2

(12) United States Patent
Kim et al.

(10) Patent No.: US 10,131,031 B2
(45) Date of Patent: Nov. 20, 2018

(54) CHEMICAL-MECHANICAL WAFER POLISHING DEVICE

(71) Applicant: TSC Inc., Hwaseong-si, Gyeonggi-do (KR)

(72) Inventors: Oh Su Kim, Suwon-si (KR); Byung Ho Kwon, Hwaseong-si (KR)

(73) Assignee: TSC Inc., Hwaseong-si, Gyeonggi-do (KR)

( * ) Notice: Subject to any disclaimer, the term of this patent is extended or adjusted under 35 U.S.C. 154(b) by 244 days.

(21) Appl. No.: 15/373,053

(22) Filed: Dec. 8, 2016

(65) Prior Publication Data

US 2017/0232574 A1 Aug. 17, 2017

(30) Foreign Application Priority Data

Feb. 17, 2016 (KR) ..... 10-2016-0018518

(51) Int. Cl.
*B24B 53/095* (2006.01)
*B24B 37/20* (2012.01)

(52) U.S. Cl.
CPC ..... *B24B 37/20* (2013.01); *B24B 53/095* (2013.01)

(58) Field of Classification Search
CPC ..... B24B 3/095; B24B 53/00; B24B 37/20
USPC .... 451/288, 289, 290, 287, 285, 41, 53, 449
See application file for complete search history.

(56) References Cited

U.S. PATENT DOCUMENTS 7,001,257 B2 * 2/2006 Chen ..... B24B 37/30 451/288
7,357,699 B2 * 4/2008 Togawa ..... B24B 37/30 451/288
7,822,500 B2 * 10/2010 Kobayashi ..... B24B 49/10 451/5
8,088,299 B2 * 1/2012 Chen ..... B24B 37/30 216/88

FOREIGN PATENT DOCUMENTS

KR 20090106886 A 10/2009
KR 101550187 B1 9/2015

* cited by examiner

*Primary Examiner* — Robert Rose
(74) *Attorney, Agent, or Firm* — Hauptman Ham, LLP

(57) ABSTRACT

Disclosed is a chemical-mechanical wafer polishing device having an elastic membrane including a circular action plate portion, a membrane circumferential wall portion extending from a circumferential edge of the action plate portion along a direction perpendicular to a plate surface, and a chamber formed between the action plate portion and the membrane circumferential wall portion. The membrane includes a cooling channel portion having an action plate bottom surface section, and a supply penetration section penetrating the action plate portion such that one end is connected to the action plate bottom surface section and the other end is exposed to the upper side of the action plate portion. The chemical-mechanical wafer polishing device includes a cooling fluid supply portion having a cooling fluid supply tube connected to a free end of the supply penetration section, and providing a cooling fluid to the cooling channel portion.

12 Claims, 14 Drawing Sheets

CHEMICAL-MECHANICAL WAFER POLISHING DEVICE

CROSS REFERENCE TO RELATED APPLICATION

This application is based upon and claims the benefit of priority from Korean Patent Application No. 10-2016-0018518, filed on Feb. 17, 2016 in the Korean Intellectual Property Office, the entire contents of which is incorporated herein by reference.

BACKGROUND OF THE INVENTION

1. Field of the Invention

The present invention relates to a chemical-mechanical wafer polishing device, and more particularly to a device for polishing the surface of a wafer by causing friction between a polishing pad and a wafer while supplying slurry (including a polishing agent) to the surface of the polishing pad.

2. Description of the Prior Art

Wafers, which are used to manufacture integrated circuits and other types of electronic elements, are fabricated through a process of depositing multiple layers, which are made of a conductive material, a semi-conductive material, and a dielectric material, on the surface of a substrate or removing the same.

The surface of a wafer, fabricated in this manner, becomes non-planar while going through the deposition or removal process, and is therefore planarized through a polishing process.

As a kind of device for polishing wafers, a chemical-mechanical wafer polishing device is used, which polishes the surface of a wafer by causing friction between the wafer and a polishing pad while supplying slurry (including a polishing agent) to the surface of the polishing pad.

The process of polishing a wafer using the polishing pad is conducted while the wafer is pressurized to contact the polishing pad (normally 5-7 psi) and then rotated; as a result, frictional heat is generated during the polishing process, and the frictional heat increases the surface temperature of the wafer, thereby causing a temperature deviation on the surface of the wafer.

The rate of polishing of the surface of a wafer has a correlation with the surface temperature of the wafer (the higher the surface temperature is, the faster the polishing proceeds); therefore, in order to stably maintain the flatness of the wafer, a chemical-mechanical wafer polishing device has been devised and used, which has a cooling fluid supply portion for cooling the heat generated by friction between the wafer and the polishing pad.

FIG. 15 is a perspective view illustrating assembled major parts of a conventional chemical-mechanical polishing device, and FIG. 16 is a sectional view illustrating major parts of the conventional chemical-mechanical polishing device.

The conventional chemical-mechanical wafer polishing device, as illustrated in the drawings, includes: a polishing pad 111; a polishing head 120 installed on the upper side of the polishing pad 110 so as to lie opposite the polishing pad 111; a membrane 140, which is installed on the polishing head 120 so as to face the polishing pad 111; a chamber pressure adjustment portion 113, which is installed on the upper side of the polishing head 120, and which has a nitrogen fluid supply line 113*a*; and a cooling gas supply portion 150 configured to eject nitrogen gas towards the polishing pad 111.

The polishing pad 111 is driven by a predetermined driving unit. The configuration of the driving unit is widely known in the art, and a detailed description thereof will be omitted herein.

The polishing head 120 includes a retaining ring 121, which has the shape of a circular tube, and an upper ring 122 and a plate 123, which is arranged in the vertical direction inside the retaining ring 121.

Each of the upper ring 122 and the plate 123 has a gas inflow hole formed thereon, respectively.

The polishing head 120 is driven to rotate by a predetermined driving unit, in conformity with the wafer polishing process, or is driven to move linearly towards and away from the polishing pad 111. The configuration of the driving unit is widely known in the art, and a detailed description thereof will be omitted herein. Reference numeral 112*a* denotes a rotating shaft that constitutes the driving unit.

The membrane 140 is formed in a concave shape. The concave space of the membrane 140 forms a chamber 144.

The nitrogen gas supply line 113*a* is installed to be connected to the gas inflow hole of the upper ring 122.

The chamber pressure adjustment portion 113, as widely known in the art, adjusts the pressure inside the chamber 144 such that, by generating a positive pressure state or a negative pressure state inside the chamber 144, a drawing force, which draws the bottom surface of the membrane 140 towards the polishing head 120, and a pressurizing force, which pressurizes the bottom surface of the membrane 140 towards the polishing pad 111, can be selectively applied on the chamber 144. The pressure adjustment by the chamber pressure adjustment portion 113 is controlled in conformity with the wafer polishing process. The configuration of the chamber pressure adjustment portion 113 is widely known in the art, and a detailed description thereof will be omitted herein.

The cooling gas supply portion 150 includes an ejection tube 151, which is installed approximately at the same height as the wafer 201, and a connecting tube 152, which connects between the ejection tube 151 and the nitrogen gas supply line 113*a*.

The ejection tube 151 is installed to surround the retaining ring 121.

The ejection tube 151 has multiple ejection holes 151*a* formed thereon.

Subordinate features for supplying and recovering the cooling gas (electronic opening/closing valve) are widely known in the art, and a detailed description thereof will be omitted herein.

The time of supply of the cooling gas by the cooling gas supply portion 150 is controlled in conformity with the other wafer polishing processes.

The operation of the cooling gas supply portion 150 of the conventional chemical-mechanical wafer polishing device, which has the above-mentioned configuration, will now be described. It will be assumed, for convenience of description, that the polishing head 120 is positioned on the upper side of the polishing pad 111, and the wafer 201 contacts the upper surface of the polishing pad 111 while adhering to the bottom surface of the membrane 140 by means of the drawing force applied to the bottom surface of the membrane 140.

The control unit initially controls the chamber pressure adjustment portion 113 such that nitrogen gas is supplied to the chamber 144 through the nitrogen gas supply line 113*a*. After the nitrogen gas is supplied through the nitrogen gas supply line 113*a*, a pressurizing force is applied to the bottom surface of the membrane 140 such that the same is pressurized towards the polishing pad 111, and the wafer 201 is accordingly pressurized to contact the polishing pad 111.

The nitrogen gas, which is supplied through the nitrogen gas supply line 113*a*, successively moves through the connecting tube 152 and the ejection tube 151, and is finally ejected towards the polishing pad 111 through the ejection hole 151*a*.

The polishing head 120 and the polishing pad 111 are then rotated in opposite directions, thereby polishing the wafer 201.

The wafer 201, which is being polished, is cooled by the nitrogen gas ejected towards the polishing pad 111.

The conventional chemical-mechanical wafer polishing device has a problem in that, since the wafer 201, which is subjected to the polishing process, is cooled by the nitrogen gas ejected towards the polishing pad 111 through the ejection tube 151, which is installed to surround the retaining ring 121, the peripheral area of the wafer is mainly cooled, while the central area thereof is not properly cooled.

Such partial cooling of only the peripheral area of the wafer, with poor cooling of the central area of the wafer, results in a secondary problem in that the polishing of the central area of the wafer is accelerated, making it impossible to stably maintain the flatness of the wafer.

An example of a relevant prior art document is Korean Patent Publication No. 10-2003-0050105 (entitled "CHEMICAL MECHANICAL POLISHING APPARATUS", published on Jun. 25, 2003), and this prior art document discloses a technology regarding the conventional chemical-mechanical polishing device described above.

SUMMARY OF THE INVENTION

Therefore, an aspect of the present invention is to provide a chemical-mechanical polishing device capable of evenly cooling the peripheral area and the central area of a wafer.

According to an aspect of the present invention, there is provided a chemical-mechanical wafer polishing device including: a polishing pad; a polishing head including a polishing head body installed on an upper side of the polishing pad such that a bottom surface of the polishing head body lies opposite the polishing pad, a retaining ring coupled to a bottom surface of the polishing head body, and a membrane made of an elastic material, the membrane including a circular action plate portion, a membrane circumferential wall portion formed to extend from a circumferential edge of the action plate portion along a direction perpendicular to a plate surface of the action plate portion, and a chamber formed between the action plate portion and the membrane circumferential wall portion, the membrane being coupled to the bottom surface of the polishing head body inside the retaining ring such that a bottom surface of the action plate portion faces the polishing pad; and a chamber pressure adjustment portion configured to operate such that, according to an externally applied control signal, a drawing force, which draws the action plate portion towards the polishing head, and a pressurizing force, which pressurizes the action plate portion towards the polishing pad, can act on the chamber selectively, wherein the membrane includes a cooling channel portion having an action plate bottom surface section, which is formed on the bottom surface of the action plate portion, and which has a concave sectional shape, and a supply penetration section, which penetrates the action plate portion such that one end is connected to the action plate bottom surface section, and the other end is exposed to an upper side of the action plate portion; and the chemical-mechanical wafer polishing device includes a cooling fluid supply portion, which has a cooling fluid supply tube connected to a free end of the supply penetration section, and which provides a cooling fluid to the cooling channel portion through the cooling fluid supply tube. Alternatively, the membrane further includes a cooling channel portion having an action plate upper surface section formed on an upper surface of the action plate portion in an arch sectional shape, an action plate bottom surface section formed on the bottom surface of the action plate portion in a concave sectional shape, and a downward penetration section that penetrates the action plate portion such that one end of the action plate upper surface section and one end of the action plate bottom surface section are connected; and the chemical-mechanical wafer polishing device includes a cooling fluid supply portion, which has a cooling fluid supply tube connected to a free end of the action plate upper surface section, and which provides a cooling fluid to the cooling channel portion through the cooling fluid supply tube. Alternatively, the membrane includes a cooling channel portion having an action plate upper surface section formed on the upper surface of the action plate portion in an arch sectional shape, an action plate bottom surface section formed on the bottom surface of the action plate portion in a concave sectional shape, a supply penetration section that penetrates the action plate portion such that one end is connected to the action plate bottom surface section and the other end is exposed to the upper side of the action plate portion, and an upward penetration section that penetrates the action plate portion such that one end is connected to the action plate portion bottom surface section and the other end is connected to the action plate upper surface section; and the chemical-mechanical wafer polishing device includes a cooling fluid supply portion having a cooling fluid supply tube, which is connected to a free end of the supply penetration section, and a cooling fluid recovery tube, which is connected to a free end of the action plate upper surface section, the cooling fluid supply portion supplying a cooling fluid to the cooling channel portion through the cooling fluid supply tube and recovering the cooling fluid, which has been supplied to the cooling channel portion, through the cooling fluid recovery tube.

In this case, the action plate upper surface section or the action plate bottom surface section is preferably formed to extend through each of the chambers such that the wafer can be evenly cooled.

In addition, the action plate bottom surface section is preferably formed to be arranged in the radial direction from the center of the action plate portion such that the cooling fluid can be discharged efficiently.

Therefore, according to the present invention, heat resulting from friction between the wafer and the polishing pad during the polishing process is removed by causing a cooling fluid to pass through the cooling channel portion, which has the entire or partial section on the upper surface of the action plate portion, or which has the entire or partial section on the bottom surface of the action plate portion; as a result, the peripheral area of the wafer and the central area of the wafer can be evenly cooled.

When the peripheral area of the wafer and the central area of the wafer are evenly cooled in this manner, polishing is conducted approximately at the same rate throughout the entire area of the wafer, making it possible to stably maintain the flatness of the wafer.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Hereinafter, the present invention will be described in detail with reference to the accompanying drawings.

Figure 1:
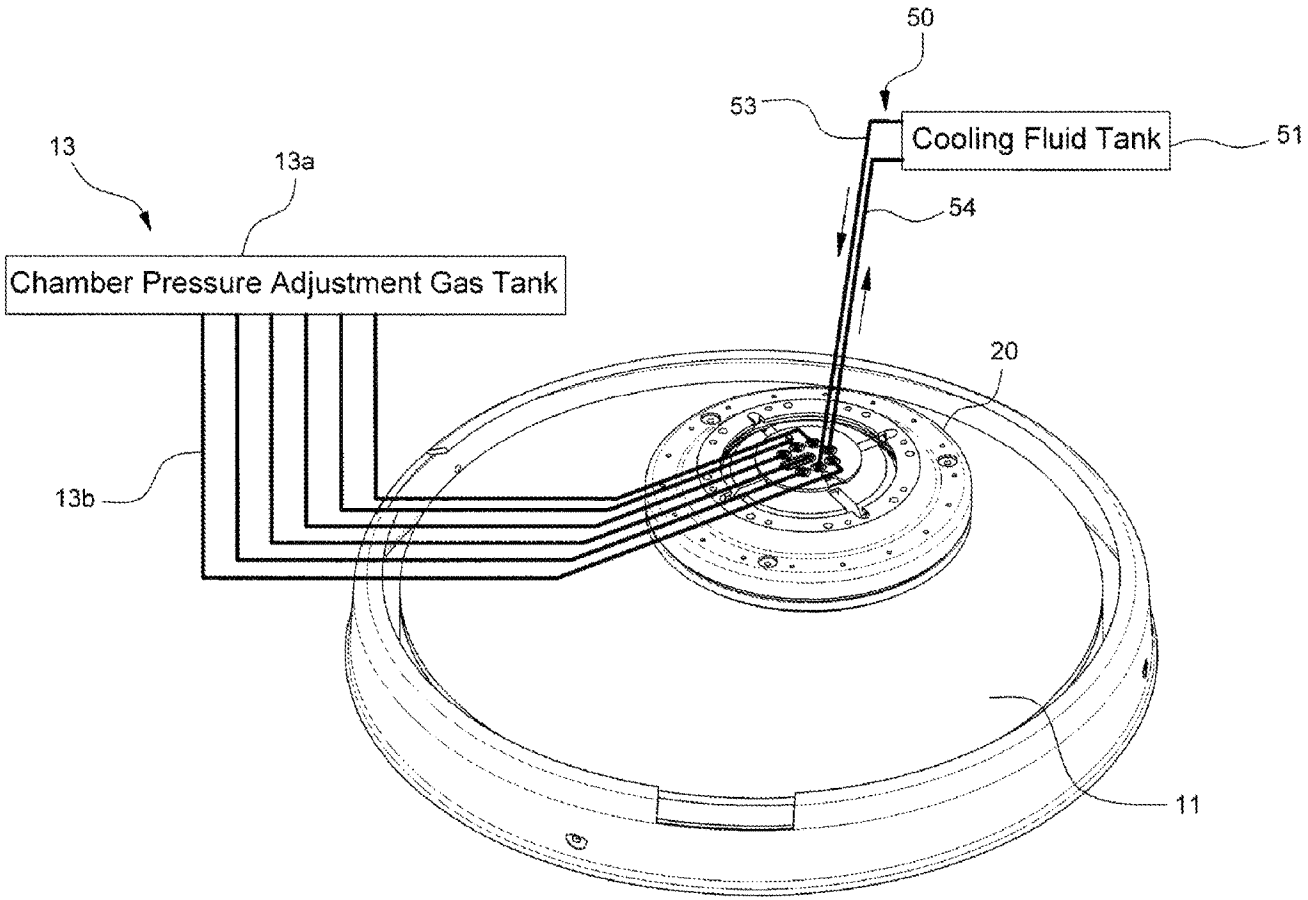
FIG. 1 is a diagram illustrating a schematic configuration of a chemical-mechanical wafer polishing device according to an embodiment of the present invention.
Figure 2:
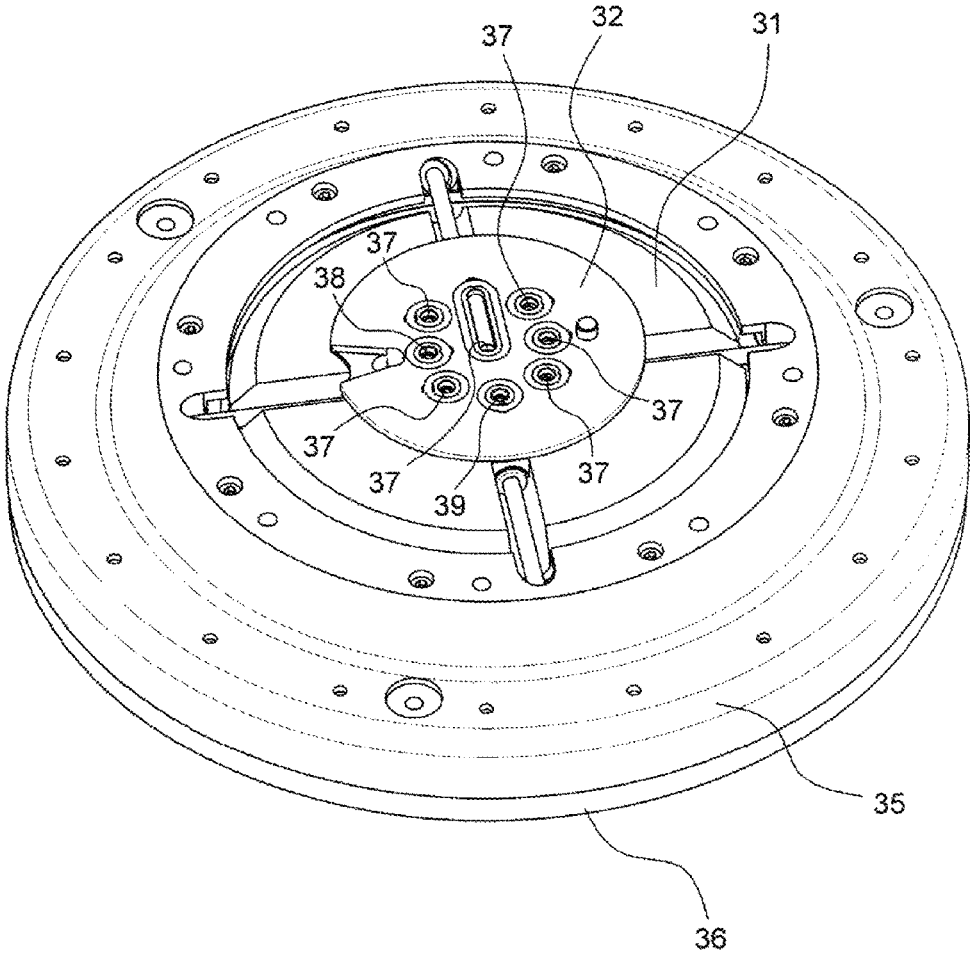
FIG. 2 is an assembled perspective view of a polishing head of a chemical-mechanical wafer polishing device according to an embodiment of the present invention.
Figure 3:
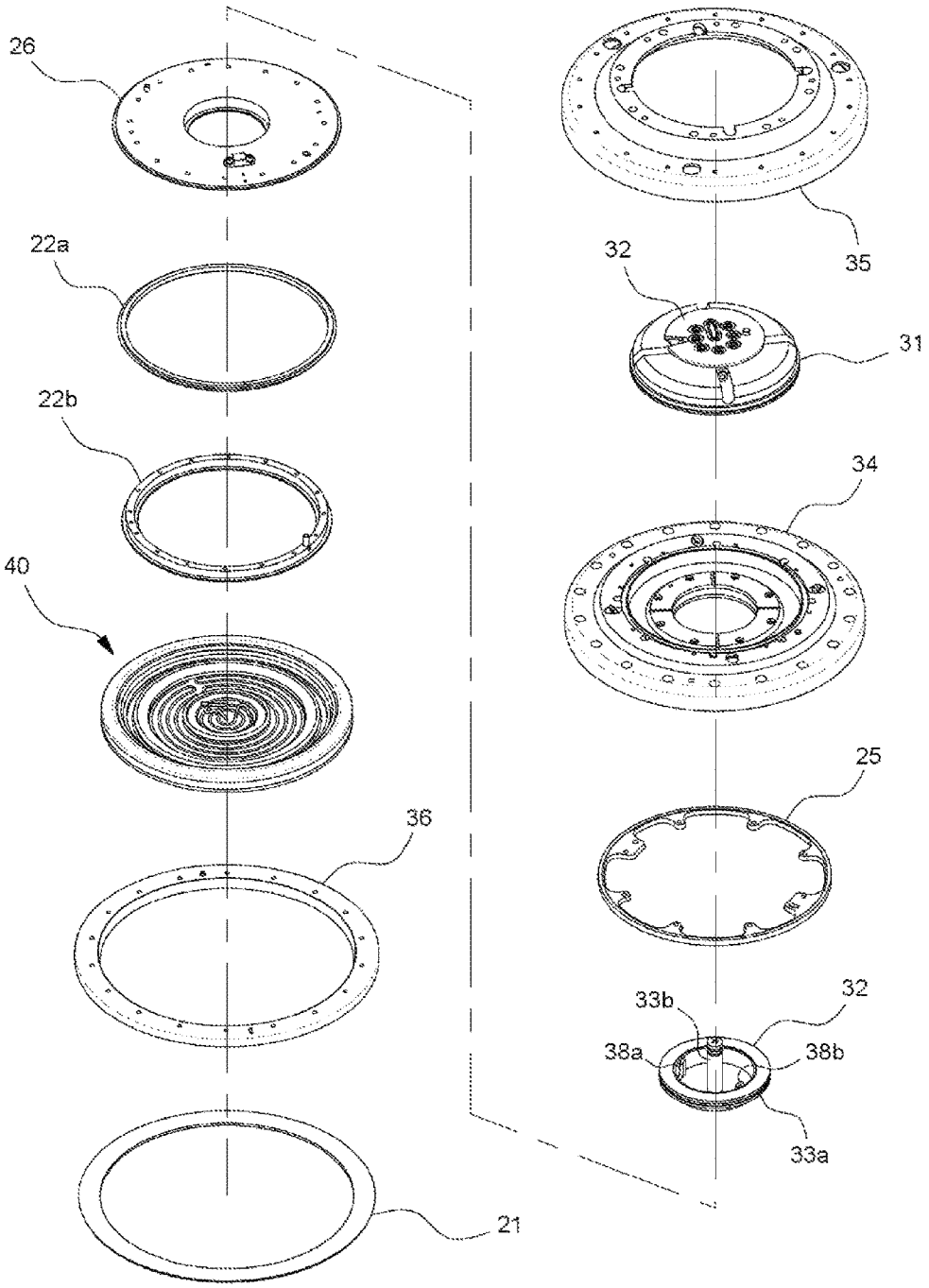
FIG. 3 is an exploded perspective view of a polishing head of a chemical-mechanical wafer polishing device according to an embodiment of the present invention.
Figure 4:
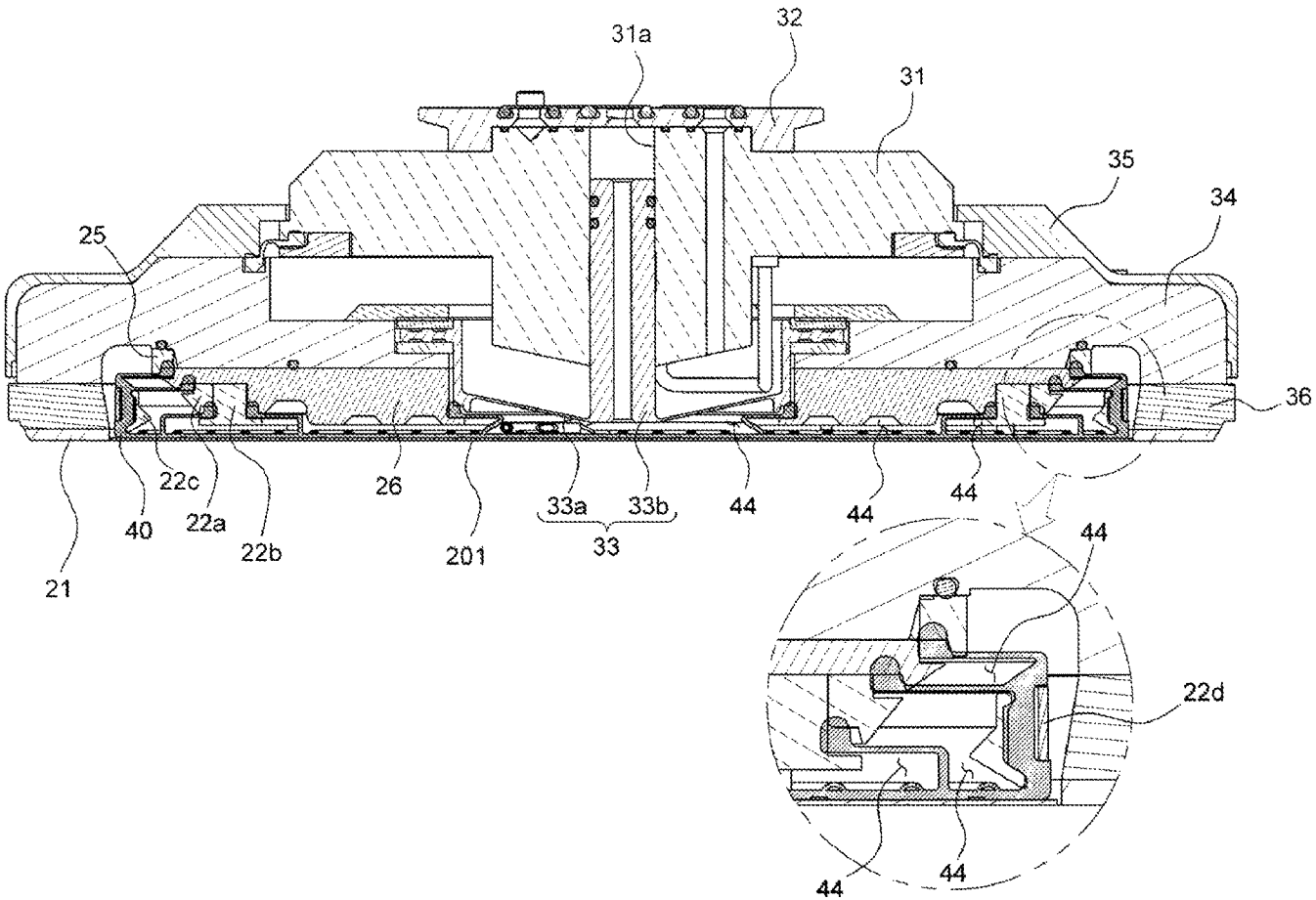
FIG. 4 and FIG. 5 are sectional views illustrating a polishing head of a chemical-mechanical wafer polishing device according to an embodiment of the present invention, respectively.
Figure 5:
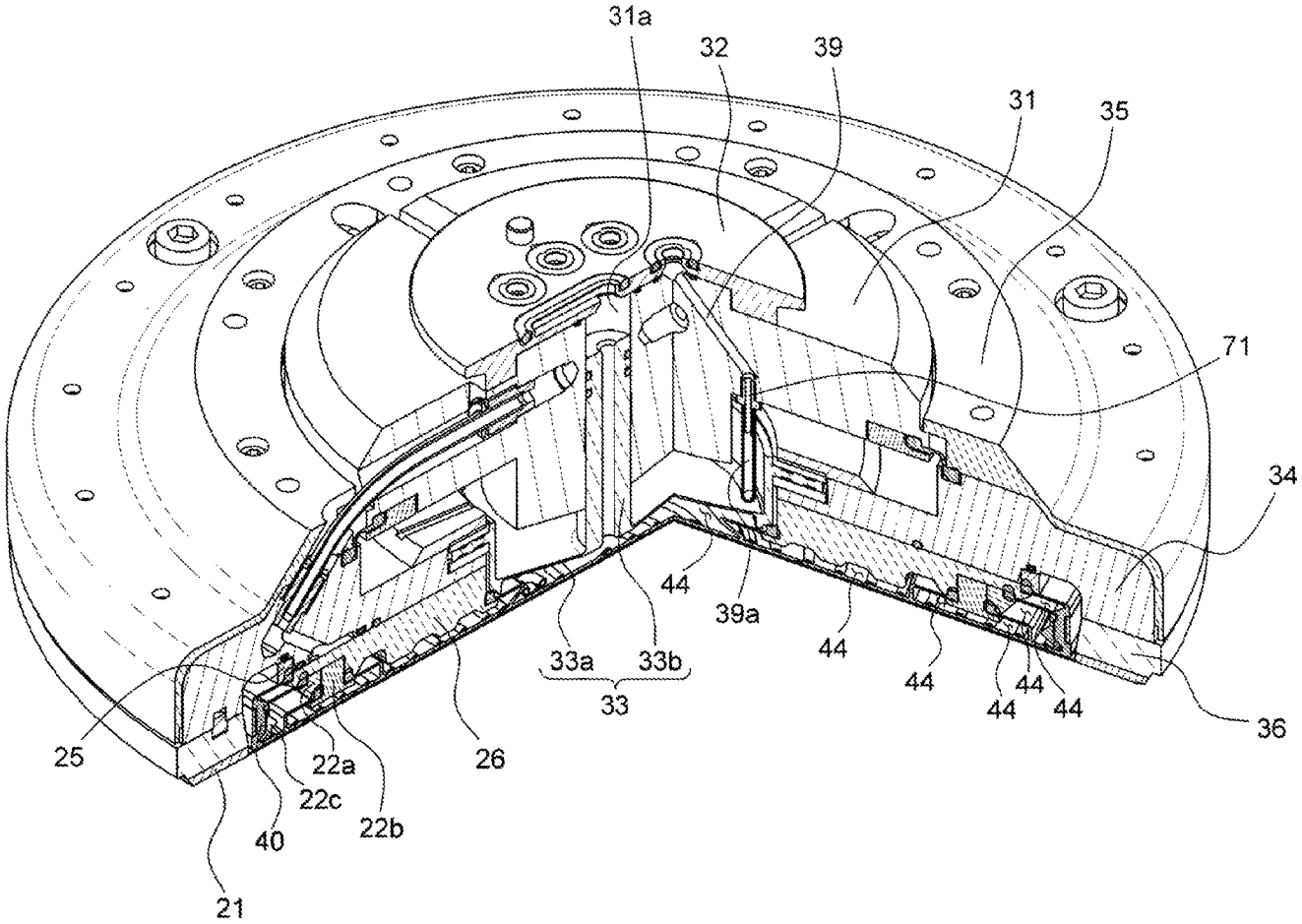
Figure 6:
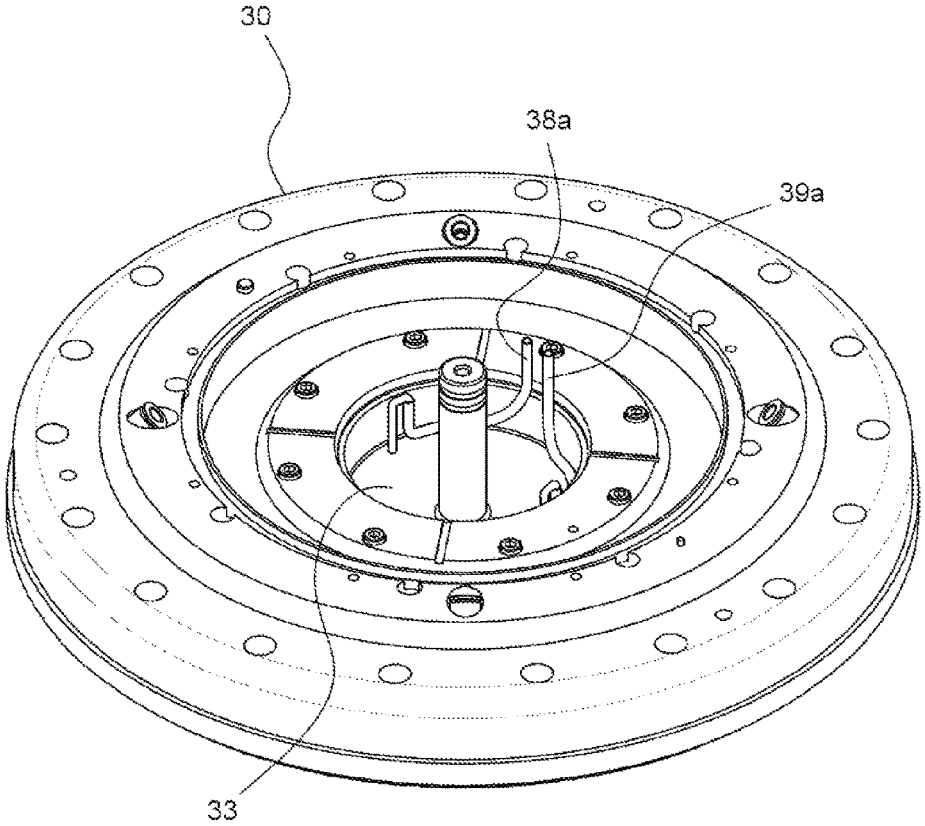
FIG. 6 is a diagram illustrating a rolling seal area of a chemical-mechanical wafer polishing device according to an embodiment of the present invention.
Figure 7:
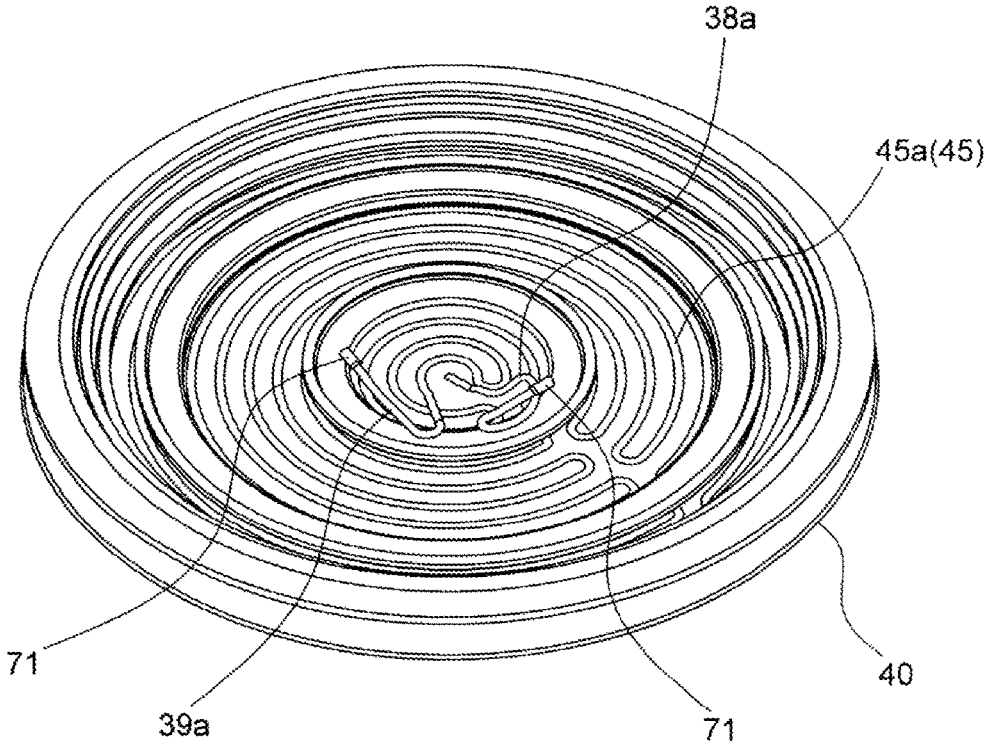
FIG. 7 and FIG. 8 are diagrams illustrating a membrane of a chemical-mechanical wafer polishing device according to an embodiment of the present invention, respectively.
Figure 8:
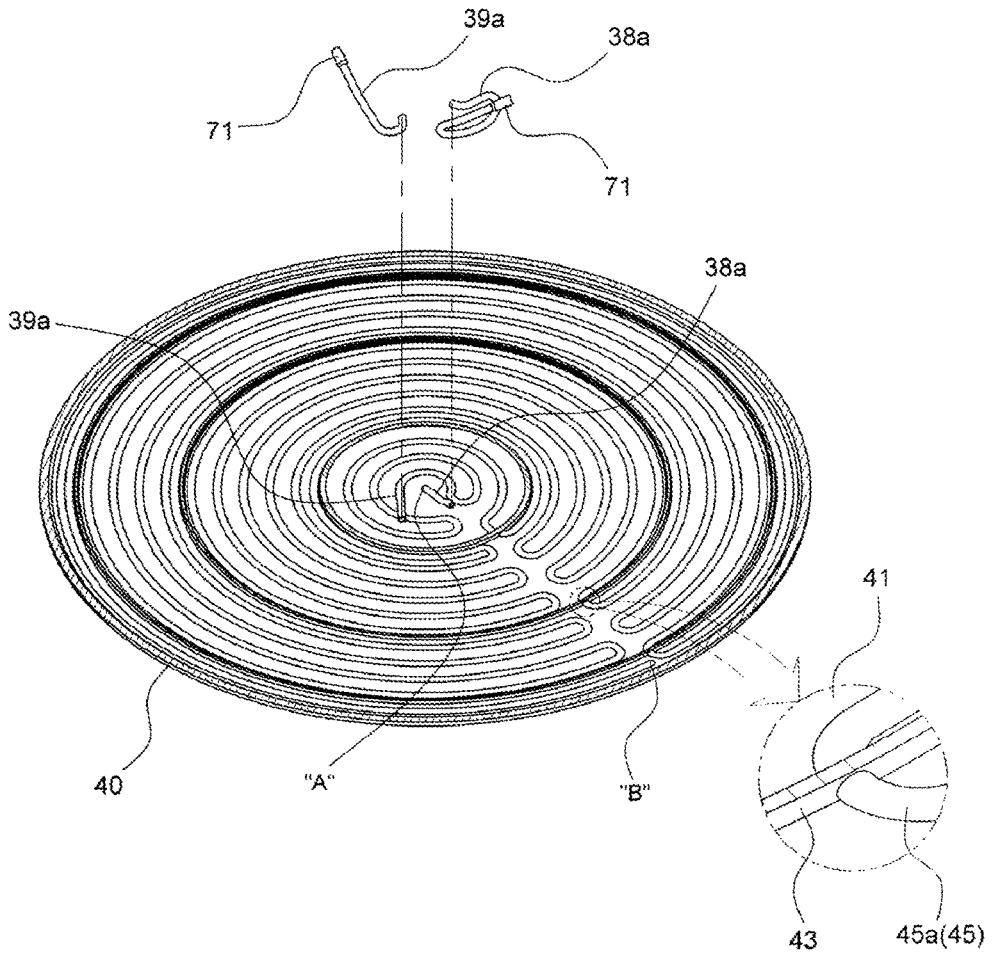
Figure 9:
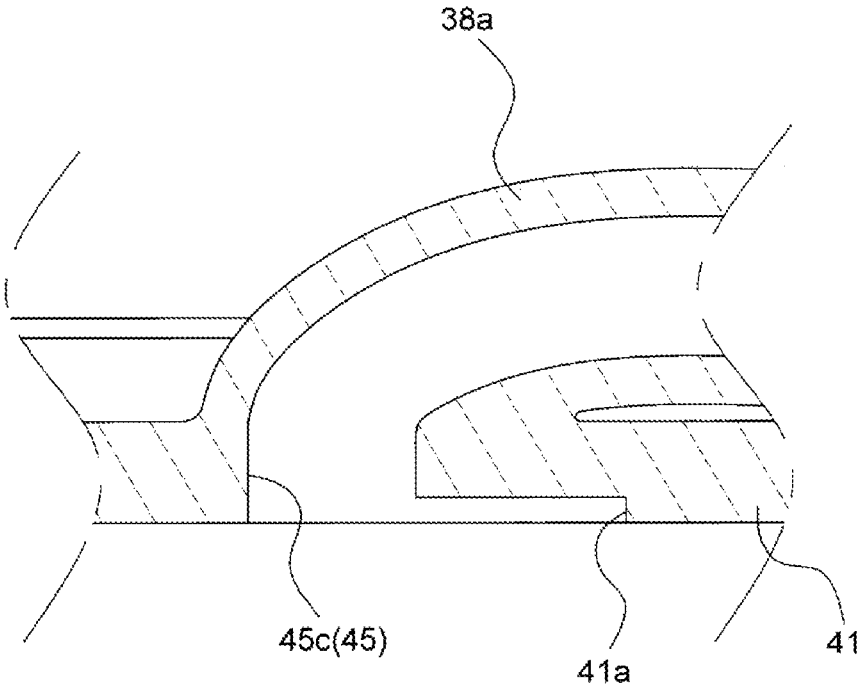
FIG. 9 is a diagram illustrating area "A" of FIG. 8.
Figure 10:
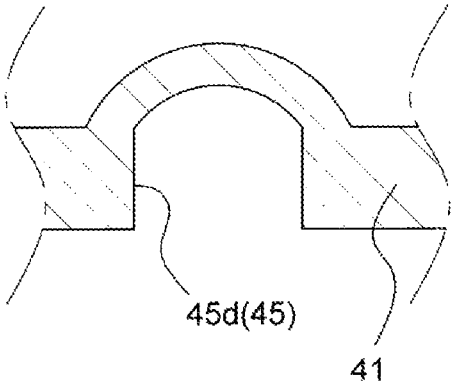
FIG. 10 is a diagram illustrating area "B" of FIG. 8.
Figure 11:
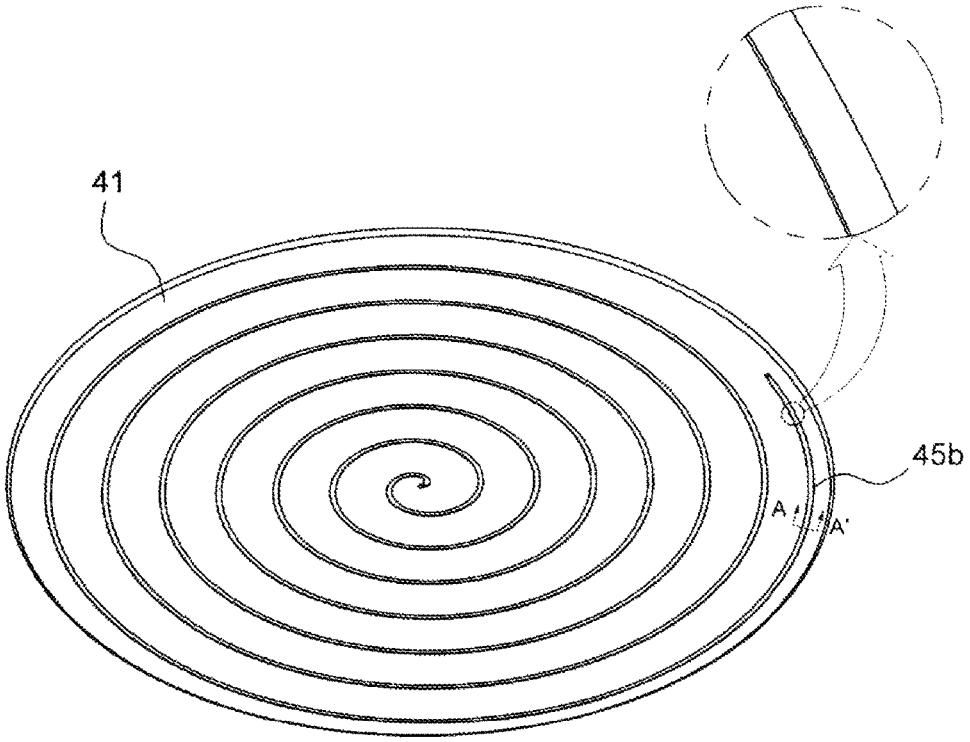
FIG. 11 is a diagram illustrating the bottom area of a membrane of a chemical-mechanical wafer polishing device according to an embodiment of the present invention.
Figure 12:
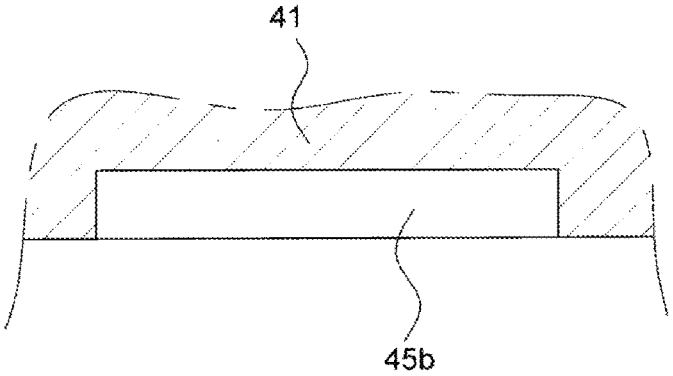
FIG. 12 is a sectional view taken along line A-A' of FIG. 11.

FIG. 1 is a diagram illustrating a schematic configuration of a chemical-mechanical wafer polishing device according to an embodiment of the present invention; FIG. 2 is an assembled perspective view of a polishing head of a chemical-mechanical wafer polishing device according to an embodiment of the present invention; FIG. 3 is an exploded perspective view of a polishing head of a chemical-mechanical wafer polishing device according to an embodiment of the present invention; FIG. 4 and FIG. 5 are sectional views illustrating a polishing head of a chemical-mechanical wafer polishing device according to an embodiment of the present invention, respectively; FIG. 6 is a diagram illustrating a rolling seal area of a chemical-mechanical wafer polishing device according to an embodiment of the present invention; FIG. 7 and FIG. 8 are diagrams illustrating a membrane of a chemical-mechanical wafer polishing device according to an embodiment of the present invention, respectively; FIG. 9 is a diagram illustrating area "A" of FIG. 8; FIG. 10 is a diagram illustrating area "B" of FIG. 8; FIG. 11 is a diagram illustrating the bottom area of a membrane of a chemical-mechanical wafer polishing device according to an embodiment of the present invention; and FIG. 12 is a sectional view taken along line A-A' of FIG. 11.

A chemical-mechanical wafer polishing device according to the present invention, as illustrated in the drawings, includes: a polishing pad 11; a polishing head 20 installed on the upper side of the polishing pad 11 so as to lie opposite the polishing pad 11; a chamber pressure adjustment portion 13 configured to adjust the pressure of a chamber 44 (described later); and a cooling fluid supply tube 50 configured to supply a cooling fluid to a cooling channel portion 45 (described later).

The polishing pad 11 is rotated by a predetermined driving unit. The configuration of the driving unit is widely known in the art, and a detailed description thereof will be omitted therein.

The polishing head 20 includes a polishing head body 30, a retaining ring 21 coupled to the bottom surface of the polishing head body 30, and a membrane 40, which is coupled to the bottom surface of the polishing head 30, and which is made of an elastic material (for example, silicone rubber).

The polishing head body 30 includes a carrier 31 having a guide hole 31*a* formed at the center thereof along the vertical direction; a flange 32 coupled to the upper surface of the carrier 31; a rolling seal 33 installed to be able move in the vertical direction along the guide hole 31*a* of the carrier 31; a support block 34 installed in the peripheral area of the rolling seal 33; a cover 35 coupled to the upper side of the support block 34; and a compressing ring 36 coupled to the bottom surface of the support block 34.

The polishing head body 30 has a pressure adjustment gas channel 37, a cooling fluid supply channel 38, and a cooling fluid recovery channel 39.

The pressure adjustment gas channel 37 is formed to be connected to each chamber 44.

The cooling fluid supply channel 38 is formed to penetrate the bottom surface of the rolling seal 33 and connect to a supply penetration section 45*c* (described later).

The cooling fluid recovery channel 39 is formed to penetrate the bottom surface of the rolling seal 33 and connect to an action plate upper surface section 45*a* (described later).

The cooling fluid supply channel 38 and the cooling fluid recovery channel 39 have partial sections formed using supply piping 38*a*, recovery piping 39*a*, and a connector 71.

The rolling seal 33 has a concave rolling seal body portion 33*a* and a guide rod 33*b* formed in an upright position on the bottom surface of the rolling seal body portion 33*a*.

The rolling seal 33, which has the above-mentioned configuration, is installed such that the guide rod 33*b* enters the guide hole 31*a* from below.

The retaining ring 21 is coupled to the bottom surface of the compressing ring 36.

The rolling seal 33, the support block 34, the head cover 35, the compressing ring 36, and the retaining ring 21 are configured to be able to move linearly in the vertical direction with regard to the carrier 31.

The membrane 40 includes a circular action plate portion 41, a membrane circumferential wall portion 42, which is formed to extend from the circumferential edge of the action plate portion 41 along a direction perpendicular to the plate surface of the action plate portion 41, and which has a circular section; a chamber forming portion 43, which is formed to extend from the upper surface of the action plate portion 41 so as to form a plurality of chambers 44 inside the membrane circumferential wall portion 42; and a cooling channel portion 45 formed on the action plate portion 41.

The cooling channel portion 45 includes an action plate upper surface section 45*a* formed on the upper surface of the action plate portion 41; an action plate bottom surface section 45*b* formed on the bottom surface of the action plate portion 41; and a supply penetration section 45*c* and an upward penetration section 45*d*, which are formed to penetrate the action plate portion 41.

The action plate upper surface section 45*a* is formed to have an arch sectional shape.

The action plate upper surface section 45*a* is formed to extend through each chamber 44.

The action plate bottom surface section 45*b* is formed to have a concave sectional shape.

The action plate bottom surface section 45*b* is formed to extend through each chamber 44.

The supply penetration section 45*c* is formed such that one end thereof is connected to a free end of the action plate bottom surface section 45*b*, while the other end thereof is exposed to the upper side of the action plate portion 41.

The upward penetration section 45*d* is formed such that one end thereof is connected to the action plate upper surface section 45*a*, while the other end thereof is connected to the action plate bottom surface section 45*b*.

The membrane 40 is fixed to the bottom surface of the polishing head body 30, inside the retaining ring 21, with the air of an inner support ring 22*c*, an outer support ring 22*d*, a support plate 26, chamber support rings 22*a* and 22*b*, and a fixing ring 25.

The polishing head 20, which has the above-mentioned configuration, is installed on the upper side of the polishing pad 11 such that the action plate portion 41 lies opposite the polishing pad 11.

The polishing head 20 is driven to rotate by a predetermined driving unit, in conformity with the wafer polishing process, or is driven to move linearly towards and away from the polishing pad 11. The configuration of the driving unit is widely known in the art, and a detailed description thereof will be omitted herein.

The chamber pressure adjustment portion 13 includes a chamber pressure adjustment gas tank 13*a*, in which a chamber pressure adjustment gas (air, nitrogen gas, etc.) is stored, and a pressure adjustment gas tube 13*b* connecting the chamber pressure adjustment gas tank 13*a* and a pressure adjustment gas channel 37, which is formed on the polishing head 20.

The chamber pressure adjustment portion 13, which has the above-mentioned configuration, adjusts the pressure inside the chamber 44, by generating a positive pressure state or a negative pressure state inside the chamber 44, such that a drawing force, which draws the action plate portion 41 towards the polishing head 20, and a pressurizing force, which pressurizes the action plate portion 41 towards the polishing pad 11, can act on the chamber 44 selectively. The pressure adjustment by the chamber pressure adjustment portion 13 is controlled in conformity with the wafer polishing process. The configuration of the chamber pressure adjustment portion 13 is widely known in the art, and a detailed description thereof will be omitted herein.

The cooling fluid supply portion 50 includes a cooling fluid tank 51, a cooling fluid supply tube 53 connected to the cooling fluid tank 51 and to one end of the cooling channel portion 45, and a cooling fluid recovery tube 54 connected to the cooling fluid tank 51 and to the other end of the cooling channel portion 45.

In connection with the cooling fluid tank 51, when the pressure adjustment gas used for the chamber pressure adjustment portion 13 can also be used as the cooling fluid, the tank of the chamber pressure adjustment portion 13 can be used as the cooling fluid tank 51. As the cooling fluid, a liquid such as DIW (De-Ionized Water), a gas such as helium gas or nitrogen gas, or a mixture of liquid and gas may be used.

The cooling fluid supply tube 53 connects the cooling fluid tank 51 and a free end of the supply penetration section 45*c*.

The cooling fluid recovery tube 54 connects the cooling fluid tank 51 and a free end of the action plate upper surface section 45*a*.

The cooling fluid supply portion 50, which has the above-mentioned configuration, supplies the cooling fluid, which is stored in the cooling fluid tank 51, to the cooling channel portion 45 through the cooling fluid supply tube 53, under the control of the control unit, and recovers the cooling fluid, which has been supplied to the cooling channel portion 45, to the cooling fluid tank 51 through the cooling fluid recovery tube 54. Subordinate features for supplying and recollecting the cooling fluid (electronic opening/closing valve for opening/closing the cooling fluid supply tube and the cooling fluid recovery tube) are widely known in the art, and a detailed description thereof will be omitted herein.

The time to supply the cooling fluid by the cooling fluid supply portion 50 is controlled in conformity with the other wafer polishing processes.

The operation of the cooling fluid supply portion 50 of the chemical-mechanical wafer polishing device according to an embodiment of the present invention, which has the above-mentioned configuration, will now be described. It will be assumed for convenience of description that the polishing head 20 is arranged on the upper side of the polishing pad 11, and the wafer 201 contacts the upper surface of the polishing pad 11 while adhering to the bottom surface of the action plate portion 41 by means of the drawing force applied to the action plate portion 41.

The control unit initially controls the chamber pressure adjustment portion 13 such that the chamber pressure adjustment gas is supplied to the chamber 44 through the pressure adjustment gas channel 37. After the chamber pressure adjustment gas is supplied to the chamber 44, a pressurizing force is applied to the action plate portion 41 such that the same is pressurized towards the polishing pad 11, and the wafer 201 is accordingly pressurized to contact the polishing pad 11.

The control unit then controls the cooling fluid supply portion 50 such that the cooling fluid, which is stored in the cooling fluid tank 51, is supplied to the cooling channel portion 45 through the cooling fluid supply tube 53.

The polishing head 20 and the polishing pad 11 are then rotated in the same direction at different rates of rotation, thereby polishing the wafer 201.

The cooling fluid, which has been supplied to the cooling channel portion 45, contacts the rear surface of the wafer 201, which is being polished, thereby cooling the wafer 201.

Meanwhile, the above-described embodiment employs a feature for recovering the cooling fluid, but the present invention can also be implemented without the feature for recovering the cooling fluid (claim 3).

Figure 13:
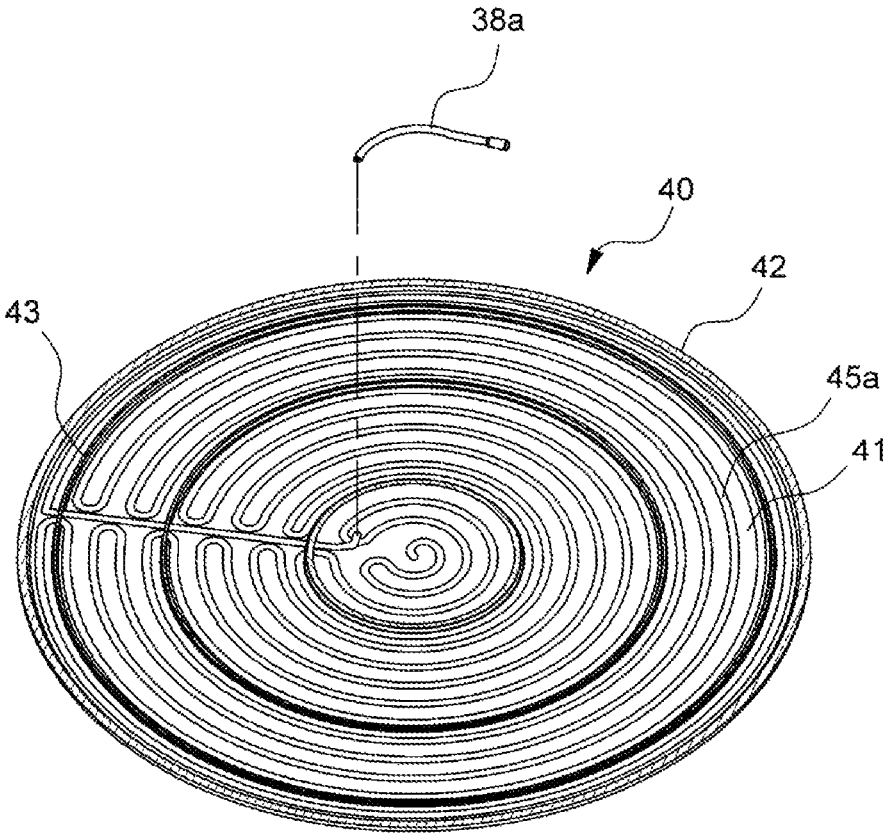
FIG. 13 is a diagram illustrating a chemical-mechanical wafer polishing device according to another embodiment of the present invention.

FIG. 13 is a diagram illustrating a chemical-mechanical wafer polishing device according to another embodiment of the present invention.

In the case of the embodiment illustrated in FIG. 13, the cooling channel portion may be formed to include an action plate upper surface section 45*a*, an action plate bottom surface section 45*b* (see FIG. 11), and an downward penetration section (which penetrates the action plate portion such that one end of the downward penetration section is connected to one end of the action plate upper surface section, and the other end thereof is connected to one end of the action plate bottom surface section). The longitudinal end of the action plate bottom surface section 45*b* (see FIG. 11) is open.

In the case of the embodiment illustrated in FIG. 13, the cooling fluid supply tube is coupled to the action plater upper surface section 45*a*, and the cooling fluid is supplied to the action plate bottom surface 45*b* (see FIG. 11) through the action plate upper surface section 45*a*. The cooling fluid, which has been supplied to the action plate bottom surface section, is discharged through pores between the retaining ring and the wafer, for example.

Figure 14:
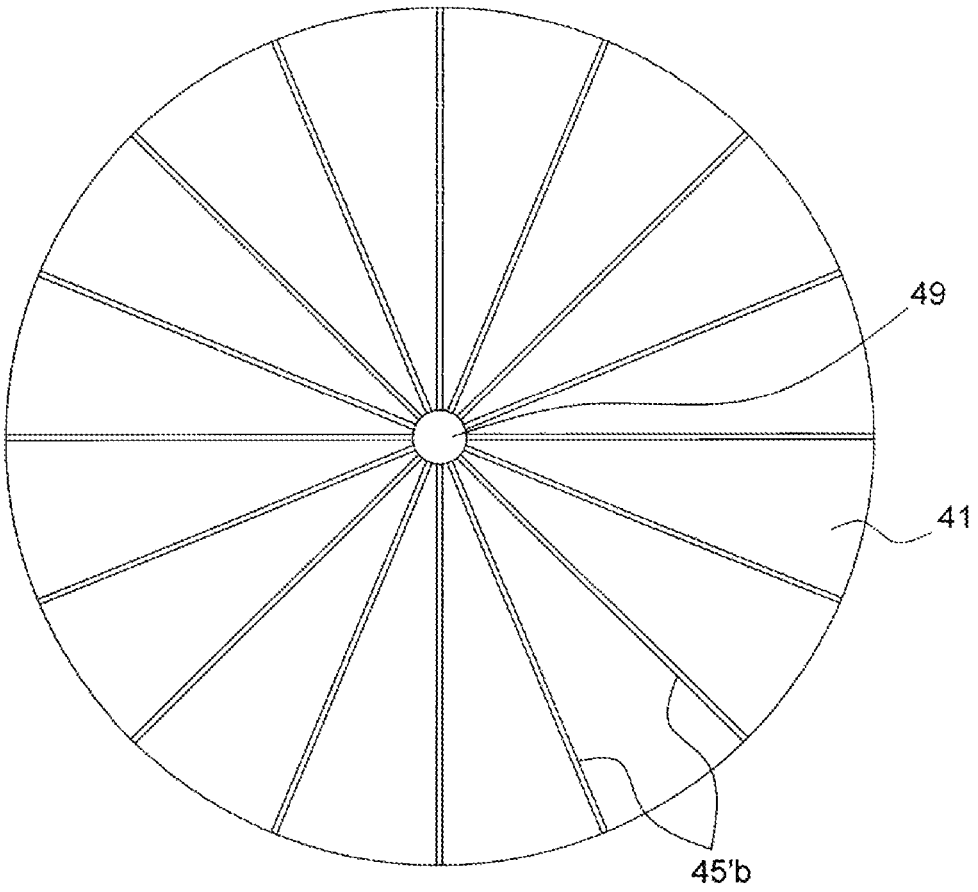
FIG. 14 is a diagram illustrating a chemical-mechanical wafer polishing device according to still another embodiment of the present invention.
Figure 15:
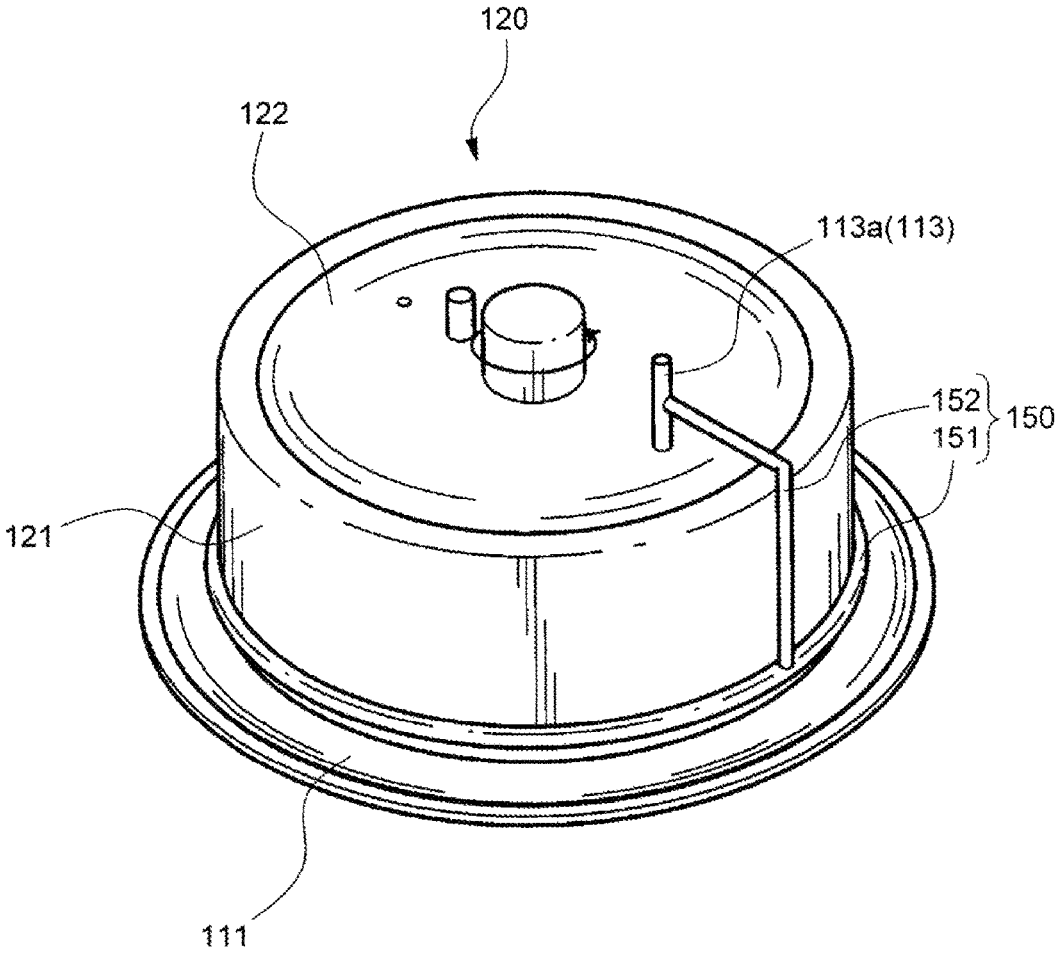
FIG. 15 PRIOR ART
FIG. 15 is a perspective view illustrating assembled major parts of a conventional chemical-mechanical wafer polishing device.
Figure 16:
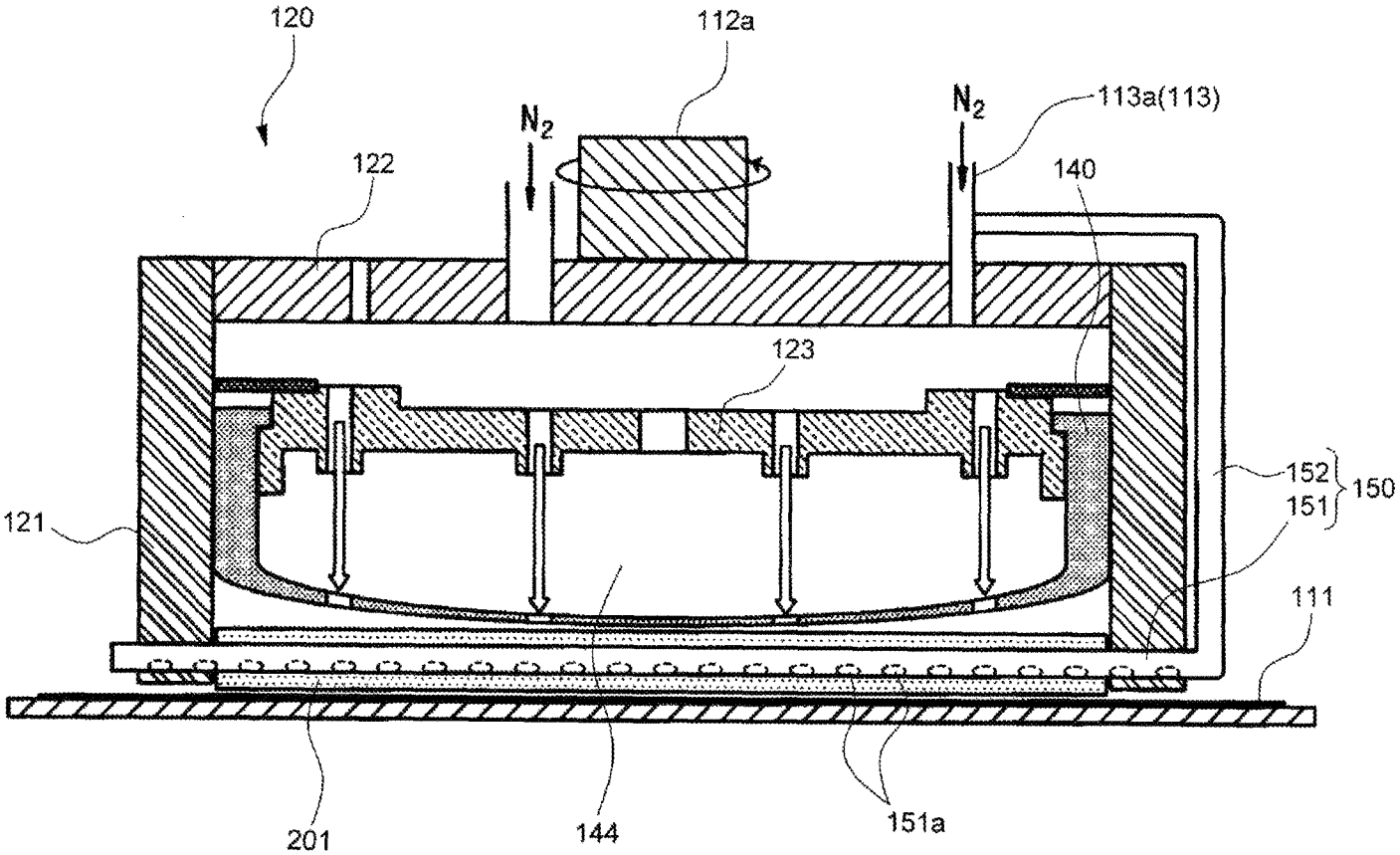
FIG. 16 PRIOR ART
FIG. 16 is a sectional view illustrating major parts of the conventional chemical-mechanical wafer polishing device.

In the case of the embodiment illustrated in FIG. 13, the action plate bottom surface section 45'*b* is preferably formed to be arranged in the radial direction from the center of the action plate portion 41, as illustrated in FIG. 14.

FIG. 14 is a diagram illustrating a chemical-mechanical wafer polishing device according to still another embodiment of the present invention.

When the action plate bottom surface section 45'*b* is formed to be arranged in the radial direction in this manner, a distribution groove 49 is formed at the center of the bottom surface of the action plate portion 41.

The distribution groove 49 is formed to communicate with the supply penetration section or the downward penetration section.

Each of the divided action plate bottom surface sections 45'*b* is connected to the distribution groove 49.

The embodiment illustrated in FIG. 1 is configured such that the cooling fluid is supplied to the action plate bottom surface section, prior to the action plate upper surface section, and is then recovered; however, it could also be configured such that, by adding a recovery penetration section, which penetrates the action plate portion, to the cooling channel portion, and by adding a cooling fluid recovery tube to the cooling fluid supply portion, the cooling fluid is supplied to the action plate upper surface section, prior to the action plate bottom surface section, and then is recovered through the recovery penetration section and the cooling fluid recovery tube (claim 4).

In the case of the chemical-mechanical wafer polishing device set forth in claim 5, the recovery penetration section is formed such that one end thereof is connected to a free end of the action plate bottom surface section, while the other end thereof is exposed to the upper side of the action plate portion.

The cooling fluid recovery tube is connected to a free end of the recovery penetration section.

Furthermore, although the cooling channel portion is formed to have an action plate upper surface section 45*a* and an action plate bottom surface section 45*b* in the above-described embodiment, the present invention may also be implemented by configuring the cooling channel portion so as to have only the action plate bottom surface section, the action plate upper surface section being omitted (claim 1 and claim 2).

When the cooling channel portion is configured to have only the action plate bottom surface section, the cooling fluid supplied to the action plate bottom surface section may be recovered (claim 2), or may not be recovered (claim 1).

When a configuration is implemented such that the cooling fluid supplied to the action plate bottom surface section is recovered, a recovery penetration section is added to the cooling channel portion, and a cooling fluid recovery tube is added to the cooling fluid supply portion as in the case of the chemical-mechanical wafer polishing device set forth in claim 4.

According to an embodiment of the present invention, as described above, heat resulting from friction between the wafer 201 and the polishing pad 11 during the polishing process is removed by causing a cooling fluid to pass through the cooling channel portion 45, which has a partial section on the upper surface of the action plate portion 41, or which has the entire or partial section on the bottom surface of the action plate portion 41; as a result, the peripheral area of the wafer and the central area of the wafer can be evenly cooled.

When the peripheral area of the wafer and the central area of the wafer are evenly cooled in this manner, polishing is conducted approximately at the same rate throughout the entire area of the wafer, making it possible stably maintain the flatness of the wafer.

In addition, by forming an action plate upper surface section 45*a* or an action plate bottom surface section 45*b* so as to extend through each chamber 44, the wafer can be cooled evenly.

Furthermore, by forming an action plate bottom surface section in such a shape that the same is arranged in the radial direction from the center of the action plate portion 41, the cooling fluid can be discharged efficiently.

BRIEF DESCRIPTION OF REFERENCE NUMERALS

11, 111: polishing head
13, 113: chamber pressure adjustment portion
20, 120: polishing head
21, 121: retaining ring
30: polishing head body
31: carrier
32: flange
33: rolling seal
40: membrane
41: action plate portion
42: membrane circumferential wall portion
43: chamber forming portion
44: chamber
45: cooling channel portion
50: cooling fluid supply portion
51: cooling fluid tank
53: cooling fluid supply tube
150: cooling gas supply portion

What is claimed is:

1. A chemical-mechanical wafer polishing device comprising:

a polishing pad;

a polishing head comprising a polishing head body installed on an upper side of the polishing pad such that a bottom surface of the polishing head body lies opposite the polishing pad, a retaining ring coupled to a bottom surface of the polishing head body, and a membrane made of an elastic material, the membrane comprising a circular action plate portion, a membrane circumferential wall portion formed to extend from a circumferential edge of the action plate portion along a direction perpendicular to a plate surface of the action plate portion, and a chamber formed between the action plate portion and the membrane circumferential wall portion, the membrane being coupled to the bottom surface of the polishing head body inside the retaining ring such that a bottom surface of the action plate portion faces the polishing pad; and a chamber pressure adjustment portion configured to operate such that, according to an externally applied control signal, a drawing force, which draws the action plate portion towards the polishing head, and a pressurizing force, which pressurizes the action plate portion towards the polishing pad, can act on the chamber selectively, wherein the membrane comprises a cooling channel portion having an action plate bottom surface section, which is formed on the bottom surface of the action plate portion, and which has a concave sectional shape, and a supply penetration section, which penetrates the action plate portion such that one end is connected to the action plate bottom surface section, and the other end is exposed to an upper side of the action plate portion; and the chemical-mechanical wafer polishing device comprises a cooling fluid supply portion, which has a cooling fluid supply tube connected to a free end of the supply penetration section, and which provides a cooling fluid to the cooling channel portion through the cooling fluid supply tube.

2. The chemical-mechanical wafer polishing device of claim 1, wherein the cooling channel portion further comprises a recovery penetration section that penetrates the action plate portion such that one end is connected to a free end of the action plate bottom surface section, and the other end is exposed to the upper side of the action plate portion; and the cooling fluid supply portion further comprises a cooling fluid recovery tube connected to a free end of the recovery penetration section, and is configured to recover a cooling fluid, which has been supplied to the cooling channel portion, through the cooling fluid recovery tube.

3. A chemical-mechanical wafer polishing device comprising:

a polishing pad;

a polishing head comprising a polishing head body installed on an upper side of the polishing pad such that a bottom surface of the polishing head body lies opposite the polishing pad, a retaining ring coupled to a bottom surface of the polishing head body, and a membrane made of an elastic material, the membrane comprising a circular action plate portion, a membrane circumferential wall portion formed to extend from a circumferential edge of the action plate portion along a direction perpendicular to a plate surface of the action plate portion, and a chamber formed between the action plate portion and the membrane circumferential wall portion, the membrane being coupled to the bottom surface of the polishing head body inside the retaining ring such that a bottom surface of the action plate portion faces the polishing pad; and a chamber pressure adjustment portion configured to operate such that, according to an externally applied control signal, a drawing force, which draws the action plate portion towards the polishing head, and a pressurizing force, which pressurizes the action plate portion towards the polishing pad, can act on the chamber selectively, wherein the membrane further comprises a cooling channel portion having an action plate upper surface section formed on an upper surface of the action plate portion in an arch sectional shape, an action plate bottom surface section formed on the bottom surface of the action plate portion in a concave sectional shape, and a downward penetration section that penetrates the action plate portion such that one end of the action plate upper surface section and one end of the action plate bottom surface section are connected; and the chemical-mechanical wafer polishing device comprises a cooling fluid supply portion, which has a cooling fluid supply tube connected to a free end of the action plate upper surface section, and which provides a cooling fluid to the cooling channel portion through the cooling fluid supply tube.

4. The chemical-mechanical wafer polishing device of claim 3, wherein the cooling channel portion further comprises a recovery penetration section that penetrates the action plate portion such that one end is connected to a free end of the action plate bottom surface section, and the other end is exposed to the upper side of the action plate portion; and the cooling fluid supply portion further comprises a cooling fluid recovery tube connected to a free end of the recovery penetration section, and is configured to recover a cooling fluid, which has been supplied to the cooling channel portion, through the cooling fluid recovery tube.

5. A chemical-mechanical wafer polishing device comprising:

a polishing pad;

a polishing head comprising a polishing head body installed on an upper side of the polishing pad such that a bottom surface of the polishing head body lies opposite the polishing pad, a retaining ring coupled to a bottom surface of the polishing head body, and a membrane made of an elastic material, the membrane comprising a circular action plate portion, a membrane circumferential wall portion formed to extend from a circumferential edge of the action plate portion along a direction perpendicular to a plate surface of the action plate portion, and a chamber formed between the action plate portion and the membrane circumferential wall portion, the membrane being coupled to the bottom surface of the polishing head body inside the retaining ring such that a bottom surface of the action plate portion faces the polishing pad; and a chamber pressure adjustment portion configured to operate such that, according to an externally applied control signal, a drawing force, which draws the action plate portion towards the polishing head, and a pressurizing force, which pressurizes the action plate portion towards the polishing pad, can act on the chamber selectively, wherein the membrane comprises a cooling channel portion having an action plate upper surface section formed on the upper surface of the action plate portion in an arch sectional shape, an action plate bottom surface section formed on the bottom surface of the action plate portion in a concave sectional shape, a supply penetration section that penetrates the action plate portion such that one end is connected to the action plate bottom surface section and the other end is exposed to the upper side of the action plate portion, and an upward penetration section that penetrates the action plate portion such that one end is connected to the action plate portion bottom surface section and the other end is connected to the action plate upper surface section; and the chemical-mechanical wafer polishing device comprises a cooling fluid supply portion having a cooling fluid supply tube, which is connected to a free end of the supply penetration section, and a cooling fluid recovery tube, which is connected to a free end of the action plate upper surface section, the cooling fluid supply portion supplying a cooling fluid to the cooling channel portion through the cooling fluid supply tube and recovering the cooling fluid, which has been supplied to the cooling channel portion, through the cooling fluid recovery tube.

6. The chemical-mechanical wafer polishing device of claim 3, wherein a plurality of chambers are formed;

the chamber pressure adjustment portion is configured to adjust the pressure of each of the chambers; and the action plate upper surface section is formed to extend through each of the chambers.

7. The chemical-mechanical wafer polishing device of claim 1, wherein a plurality of chambers are formed;

the chamber pressure adjustment portion is configured to adjust the pressure of each of the chambers; and the action plate bottom surface section is formed to extend through each of the chambers.

8. The chemical-mechanical wafer polishing device of claim 1, wherein the action plate bottom surface section is formed to be arranged in a radial direction from a center of the action plate portion.

9. The chemical-mechanical wafer polishing device of claim 5, wherein a plurality of chambers are formed;

the chamber pressure adjustment portion is configured to adjust the pressure of each of the chambers; and the action plate upper surface section is formed to extend through each of the chambers.

10. The chemical-mechanical wafer polishing device of claim 3, wherein a plurality of chambers are formed;

the chamber pressure adjustment portion is configured to adjust the pressure of each of the chambers; and the action plate bottom surface section is formed to extend through each of the chambers.

11. The chemical-mechanical wafer polishing device of claim 5, wherein a plurality of chambers are formed;

the chamber pressure adjustment portion is configured to adjust the pressure of each of the chambers; and the action plate bottom surface section is formed to extend through each of the chambers.

12. The chemical-mechanical wafer polishing device of claim 3, wherein the action plate bottom surface section is formed to be arranged in a radial direction from a center of the action plate portion.

* * * * *